US009881487B2

(12) United States Patent
Amato et al.

(10) Patent No.: US 9,881,487 B2
(45) Date of Patent: Jan. 30, 2018

(54) EMERGENCY DETECTION MECHANISM

(71) Applicant: International Business Machines Corporation, Armonk, NY (US)

(72) Inventors: Christel Amato, Bazainville (FR); Peter K. Malkin, Ardsley, NY (US); Marc P. Yvon, Antony (FR)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/938,913

(22) Filed: Nov. 12, 2015

(65) Prior Publication Data

US 2017/0140636 A1 May 18, 2017

(51) Int. Cl.

*G08B 25/01* (2006.01)
*G08B 13/196* (2006.01)
*G08B 13/19* (2006.01)

(52) U.S. Cl.

CPC ..... *G08B 25/016* (2013.01); *G08B 13/19684* (2013.01)

(58) Field of Classification Search

CPC G08B 13/19684; G08B 15/004; G08B 21/02; G08B 21/0202; G08B 25/016
USPC ..... 340/539.11, 39.11
See application file for complete search history.

(56) References Cited

U.S. PATENT DOCUMENTS 5,266,944 A * 11/1993 Carroll ..... G07C 9/00111 340/10.42
8,199,003 B2 6/2012 Aaron
8,451,131 B2 * 5/2013 Ghazarian ..... G08B 21/0258 340/539.11
8,630,820 B2 1/2014 Amis
2007/0139207 A1 * 6/2007 Agapi ..... G06K 9/00335 340/573.4
2012/0268269 A1 * 10/2012 Doyle ..... G08B 21/0202 340/539.13
2013/0214925 A1 * 8/2013 Weiss ..... G08B 25/001 340/539.11

(Continued)

OTHER PUBLICATIONS

Careless, "N.J. police, emergency management send free text alerts to public phones, PDAs (with related video)," Urgent Communications, http://urgentcomm.com/law-enforcement/nj-police-emergency-management-send-free-text-alerts-public-phones-pdas-related-vide, Mar. 28, 2012, pp. 1-4.

(Continued)

*Primary Examiner* — Omar Casillashernandez
(74) *Attorney, Agent, or Firm* — Erik K. Johnson

(57) ABSTRACT

An embodiment of the invention may include a method, a computer program product and a computer system for assessing interactions towards an electronic device. The embodiment may include a computing device that monitors a pattern of actions of a first user, where the first user is associated with a first electronic device. The embodiment may include a computing device that determines that at least one action from the first user indicates the first user is undergoing an aggressive act. The embodiment may include a computing device that responds to the aggressive act by: communicating results of the determination that the first pattern matches the data pattern to a second electronic device; and/or sending information detailing a command to activate a device component of one or both of the first electronic device and a third electronic device.

14 Claims, 6 Drawing Sheets

(56) References Cited

U.S. PATENT DOCUMENTS

| | | | | |
|---|---|---|---|---|
| 2014/0321362 | A1 | 10/2014 | Pipes | |
| 2016/0324478 | A1* | 11/2016 | Goldstein | A61B 5/721 |

OTHER PUBLICATIONS

Jackson, "App would give 911 operators control of callers' smart phones," GCN, https://gcn.com/articles/2013/06/12/911-operators-control-smart-phones.aspx, Jun. 12, 2013, pp. 1-3.
Mell et al., "The NIST Definition of Cloud Computing: Recommendations of the National Institute of Standards and Technology," NIST Special Publication 800-145, Sep. 2011, 7 pages.
Ojeda-Zapata, "Smartphones now set up with automatic alert system for weather, national emergencies," Jun. 24, 2012, TwinCities.com, http://www.twincities.com/ci_20931233/smartphones-now-set-up-automatic-alert-system-weather, pp. 1-6.
Wayne, "How to Send SMS Messages Automatically," Chron, http://smallbusiness.chron.com/send-sms-messages-automatically-48180.html, printed on Oct. 14, 2015, pp. 1-4.
"Weather warnings on the go!: Wireless Emergency Alerts Capable," National Weather Service: Communication Office, http://www.nws.noaa.gov/com/weatherreadynation/wea.html#.
Vh5viUZWJ3V, printed on Oct. 14, 2015, pp. 1-3.
"Emergency Alert Notification FAQ," California State University San Bernardino, http://police.csusb.edu/aboutUs/emergencyAlertFAQ.html, Printed on Oct. 14, 2015, pp. 1-3.
"Companion Never Walk Home Alone", http://www.companionapp.io/, Printed on Nov. 10, 2015, 5 pages.

* cited by examiner

EMERGENCY DETECTION MECHANISM

BACKGROUND

The present invention relates to detecting second users, and more particularly to the use of mobile devices to detect second users.

Aggressive acts towards an individual may have detrimental consequences towards an individual. Such consequences may include physical injury, harassment, or death of the individual. Additionally, an individual may make decisions, rational or irrational, to avoid such aggressive acts. Detecting such aggressive acts while they are occurring may reduce the harm associated with such an act, or deter an aggressor from committing such an act against an individual. Such detection techniques may have lifesaving results, and may help to reduce an individual's fear of becoming a victim of an aggressive act.

BRIEF SUMMARY

An embodiment of the invention may include a method for assessing interactions towards an electronic device. The method may include a computing device that monitors a pattern of actions of a first user, where the first user is associated with a first electronic device. The method may include a computing device that determines that at least one action from the first user indicates the first user is undergoing an aggressive act. The method may include a computing device that responds to the aggressive act by: communicating results of the determination that the first pattern matches the data pattern to a second electronic device; and/or sending information detailing a command to activate a device component of one or both of the first electronic device and a third electronic device.

Another embodiment of the invention provides a computer program product for operating a computing device for assessing interactions towards an electronic device. The computer program product may include a program instructions that monitors a pattern of actions of a first user, where the first user is associated with a first electronic device. The computer program product may include a program instructions that determines that at least one action from the first user indicates the first user is undergoing an aggressive act. The computer program product may include a program instructions that responds to the aggressive act by: communicating results of the determination that the first pattern matches the data pattern to a second electronic device; and/or sending information detailing a command to activate a device component of one or both of the first electronic device and a third electronic device.

Another embodiment of the invention provides a computer system for operating a computing device assessing interactions towards an electronic device. The computer system may include a program instructions that monitors a pattern of actions of a first user, where the first user is associated with a first electronic device. The computer system may include a program instructions that determines that at least one action from the first user indicates the first user is undergoing an aggressive act. The computer system may include a program instructions that responds to the aggressive act by: communicating results of the determination that the first pattern matches the data pattern to a second electronic device; and/or sending information detailing a command to activate a device component of one or both of the first electronic device and a third electronic device.

BRIEF DESCRIPTION OF THE SEVERAL DRAWINGS

Figure 1:
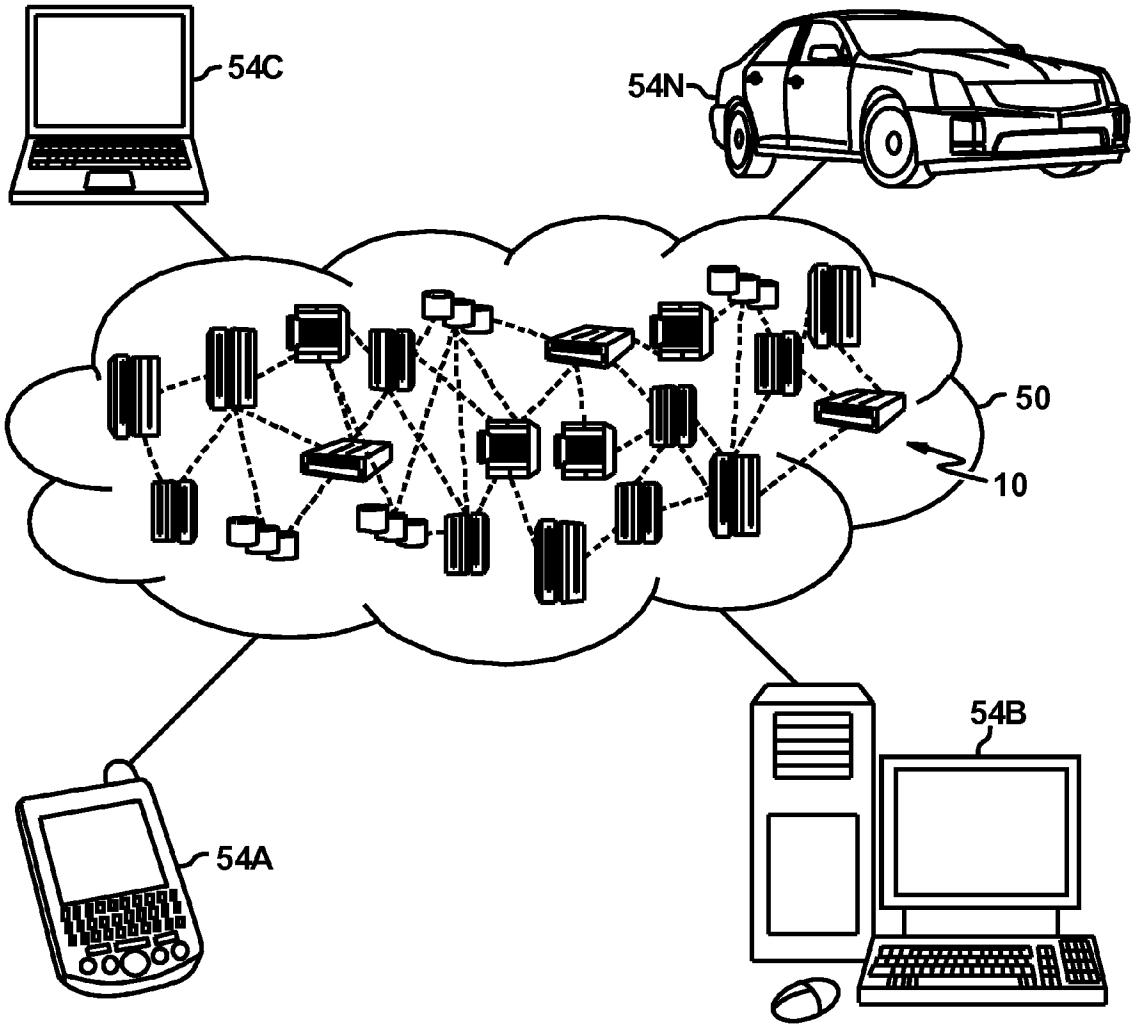
FIG. 1 depicts a cloud computing environment according to an embodiment of the present invention.
Figure 4A:
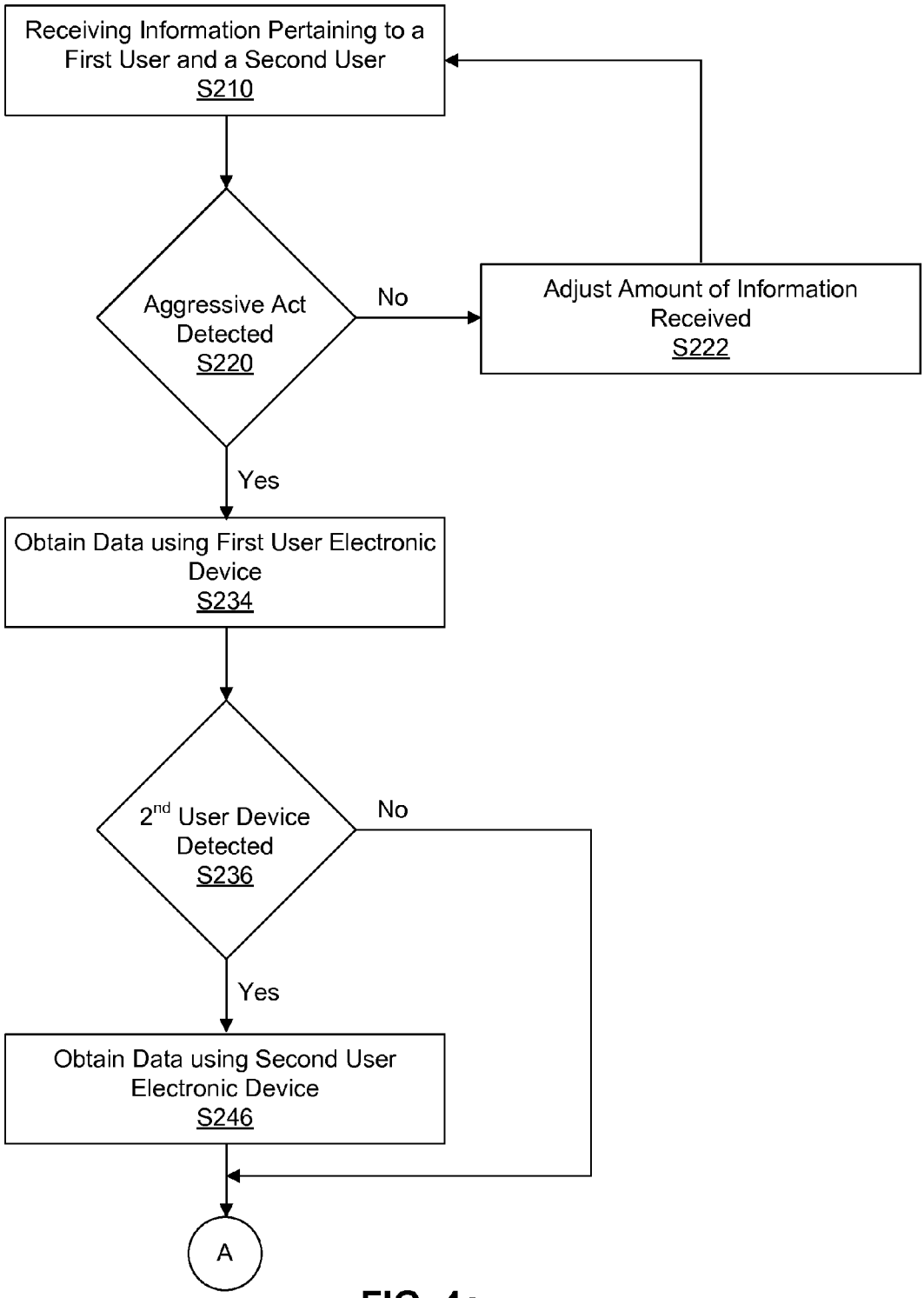
Figure 4B:
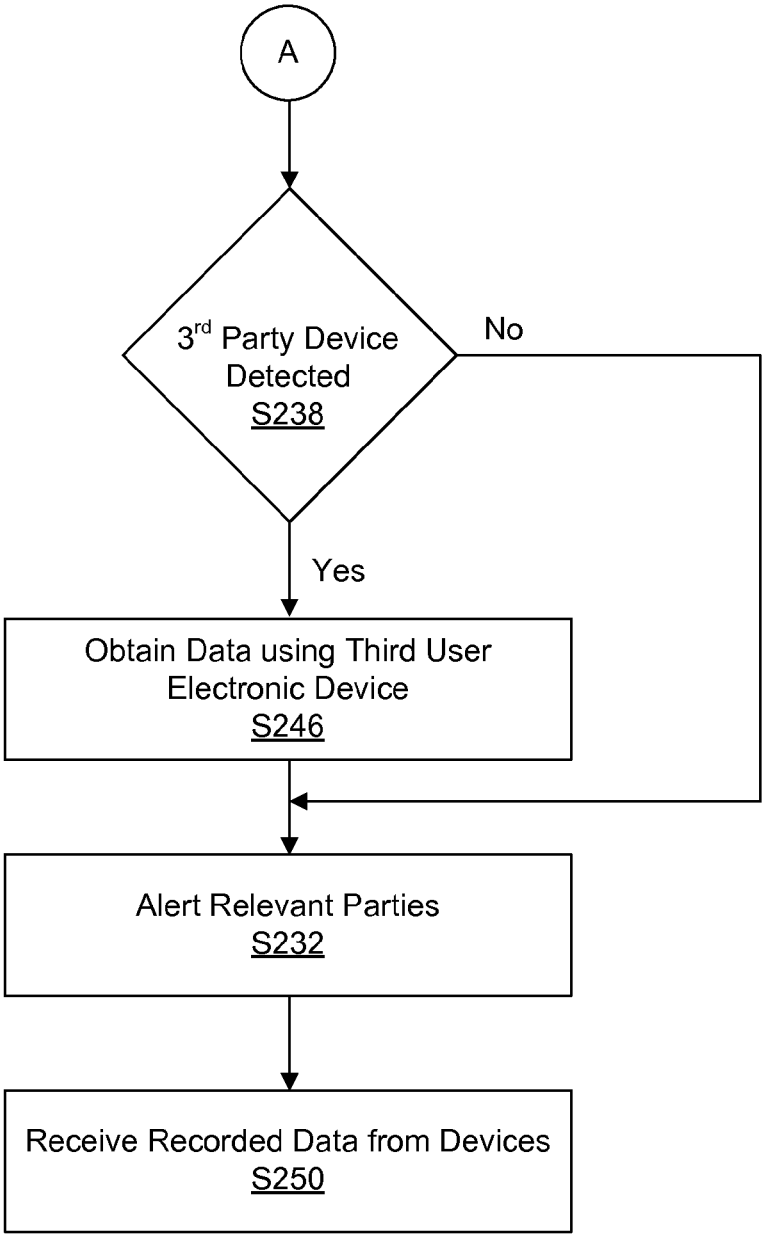
Figure 5:
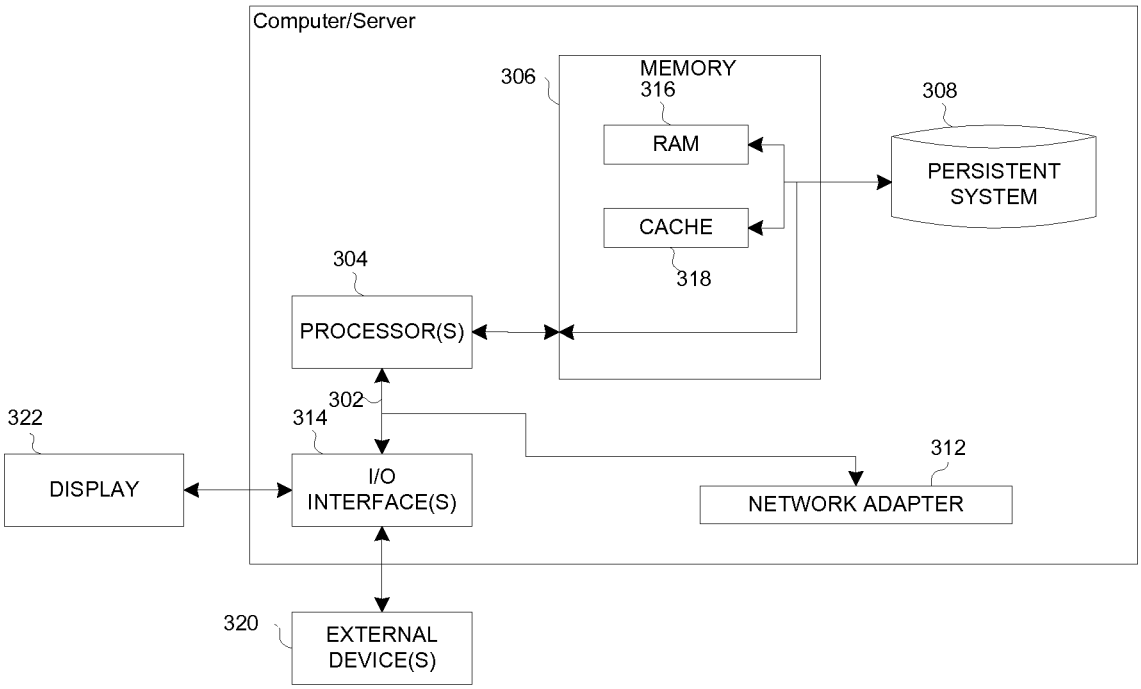

FIGS. 4*a* and 4*b* are a flowchart illustrating the operations of the aggressor monitoring program of FIG. 1 in determining what document to display based on a shortcut input, in accordance with an embodiment of the invention; and FIG. 5 is a block diagram depicting the hardware components of the service provider device, first user electronic device, second user electronic device and third party electronic device of FIG. 1, in accordance with an embodiment of the invention.

DETAILED DESCRIPTION

Embodiments of the present invention will now be described in detail with reference to the accompanying Figures.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as Follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as Follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as Follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Figure 2:
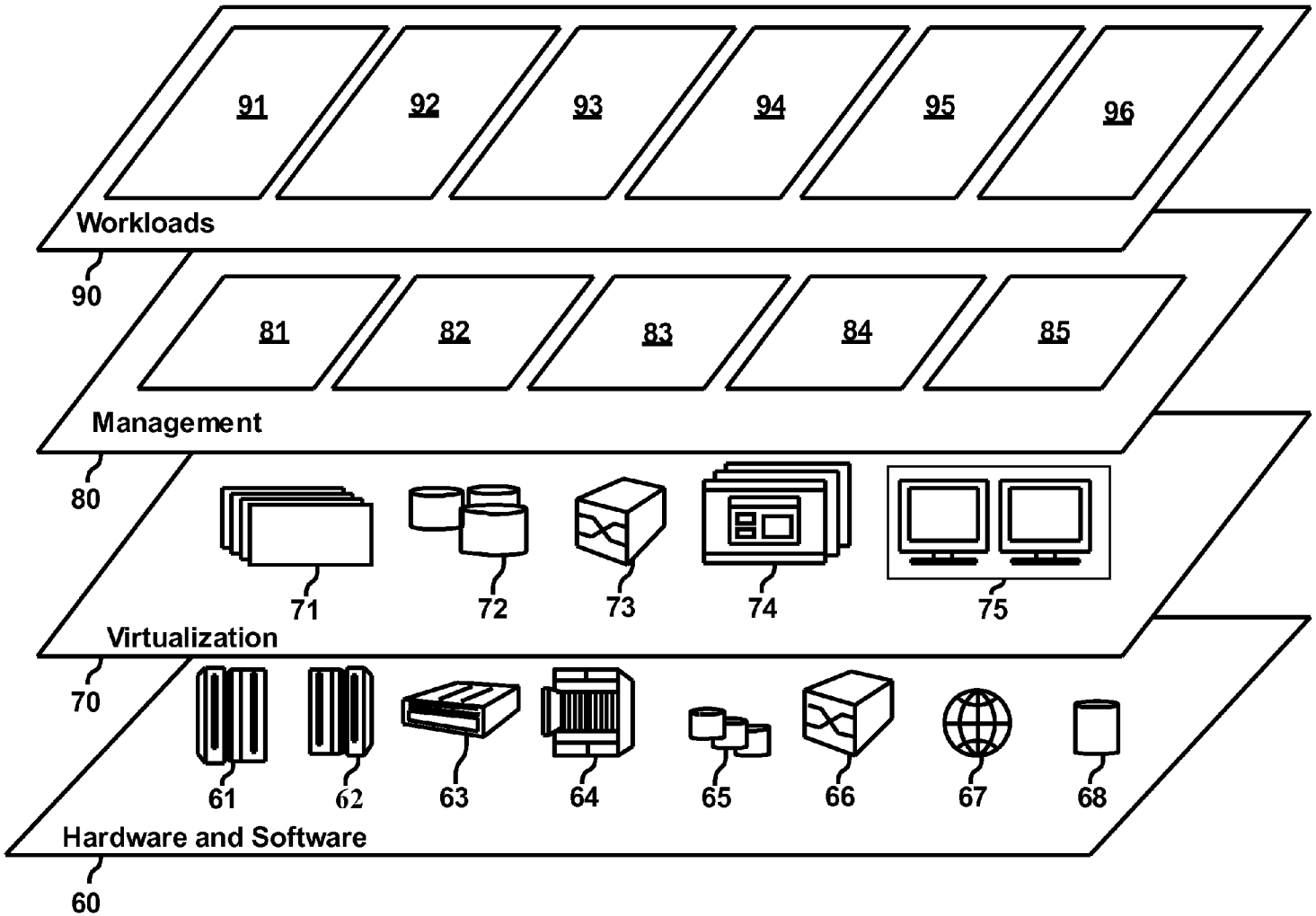
FIG. 2 depicts abstraction model layers according to an embodiment of the present invention.

Referring now to FIG. 2, a set of functional abstraction layers provided by cloud computing environment 50 (FIG. 1) is shown. It should be understood in advance that the components, layers, and functions shown in FIG. 2 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and aggressor detection 96.

Figure 3:
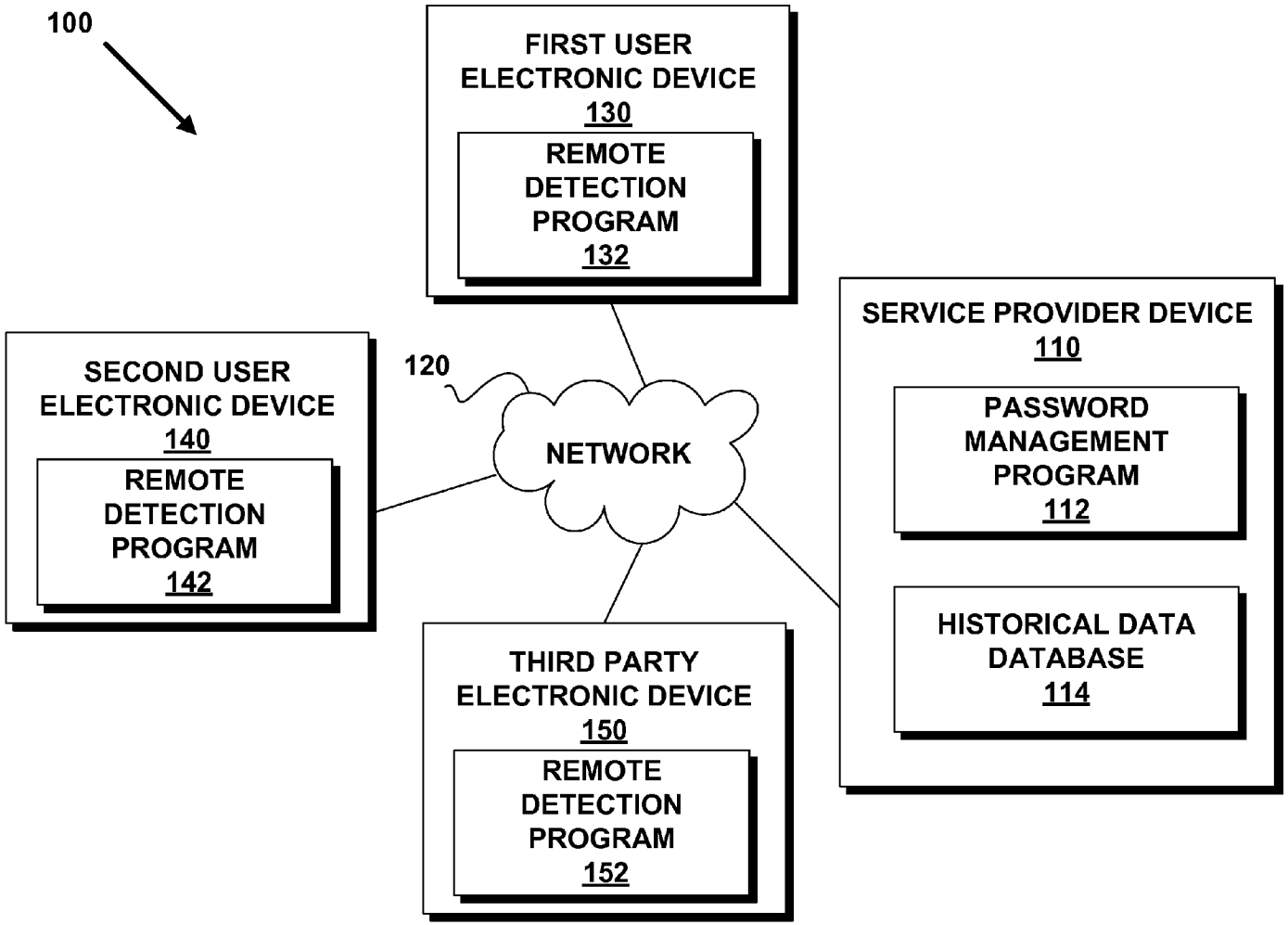
FIG. 3 illustrates a second user detection system, in accordance with an embodiment of the invention.

FIG. 3 illustrates an aggressor detection system 100, in accordance with an embodiment of the invention. In an example embodiment, aggressor detection system 100 includes a service provider device 110, a first user electronic device 130, a second user electronic device 140 and a third party mobile device 150 interconnected via a network 120.

In the example embodiment, network 120 is the Internet, representing a worldwide collection of networks and gateways to support communications between devices connected to the Internet. Network 120 may include, for example, wired, wireless or fiber optic connections. In other embodiments, network 120 may be implemented as an intranet, a local area network (LAN), or a wide area network (WAN). In general, network 120 can be any combination of connections and protocols that will support communications between the computing device service provider device 110 and the server second user electronic device 140.

First user electronic device 130 includes remote detection program 132. In an embodiment, the first user electronic device 130 is associated with a first user, and the first user may be a victim of an aggressive act. In the example embodiment, first user electronic device 130 is a smart phone, a tablet computer, a handheld device, a wearable device, an implantable device, or any other portable electronic device or mobile computing system capable of detecting local information and sending, receiving and storing data and commands to and from other devices via network 120. In additional embodiments, first user electronic device 130 may be capable of analyzing data or interacting with a user of the device. In an example embodiment, first user electronic device 130 may be capable of recording audio, visual, location, physiological or any other relevant information using components of the first user electronic device 130 such as the microphone, camera, GPS, heart-rate monitors, etc. In additional embodiments, part or all of the aggressor monitoring program 112 may be located on the first user electronic device 130. First user electronic device 130 may include internal and external hardware components, as depicted and described in further detail below with reference to FIG. 5.

Remote detection program 132 represents a program residing on first user electronic device 130 that interfaces with components of first user electronic device 130 at the behest of the aggressor monitoring program 112. Remote detection program 132 may store and transmit relevant information obtained by utilizing components of first user electronic device 130, such as cameras, microphones, GPS, gyroscopes, etc. Remote detection program 132 may, via network 120, alert the user of first user electronic device 130, second user electronic device 140 and third party electronic device 150 of the detection of an aggressive act, in an attempt to mitigate the effects. Additionally, remote detection program 132 is capable of direct communication, or transmission of information, between service provider device 110, second user electronic device 140 and third party electronic device 150.

Second user electronic device 140 includes remote detection program 142. In an embodiment, the second user may be one or more perpetrators of an aggressive act. In the example embodiment, second user electronic device 140 is a smart phone, a tablet computer, a handheld device, a wearable device, an implantable device, or any other portable electronic device or mobile computing system capable of detecting local information and sending, receiving and storing data and commands to and from other devices via network 120. In additional embodiments, second user electronic device 140 may be capable of interacting with a user of the device. In an example embodiment, second user electronic device 140 may be capable of recording audio, visual, location, physiological or any other relevant information using components of the second user electronic device 140 such as the microphone, camera, GPS, transdermal alcohol monitor, etc. Second user electronic device 140 may include internal and external hardware components, as depicted and described in further detail below with reference to FIG. 5.

Remote detection program 142 represents a program residing on second user electronic device 140 that may interface with components of the second user electronic device 140 at the behest of the aggressor monitoring program 112. Remote detection program 142 may store and transmit relevant information from cameras, microphones, GPS, gyroscopes, etc. Remote detection program 142 may also alert the operator of second user electronic device 140 that the detection of their aggressive act has occurred, in an attempt to mitigate the effects.

Third party electronic device 150 includes remote detection program 152. In the example embodiment, third party electronic device 150 is a smart phone, a tablet computer, a handheld device, a wearable device, an implantable device, or any other electronic device or mobile computing system capable of detecting local information and sending, receiving and storing data and commands to and from other devices via network 120. In additional embodiments, third party electronic device 150 may be capable of interacting with a user of the device. In an example embodiment, third party electronic device 150 may be capable of recording audio, visual, location or any other relevant information using components of the third party electronic device 150 such as the microphone, camera, GPS, etc. Third party electronic device 150 may include internal and external hardware components, as depicted and described in further detail below with reference to FIG. 5.

Remote detection program 152 represents a program residing on third party electronic device 150 that interfaces with components of the mobile device at the behest of the aggressor monitoring program 112. Remote detection program 152 may store and transmit relevant information from cameras, microphones, GPS, gyroscopes, etc. Remote detection program 152 may alert the operator third party electronic device 150 of the detection of a nearby aggressive act, in an attempt to mitigate the effects.

Service provider device 110 includes aggressor monitoring program 112. In the example embodiment, service provider device 110 is a desktop computer, a notebook, a laptop computer, a thin client, or any other electronic device or computing system capable of receiving and sending data and commands to and from other devices via network 120, and capable of determining aggressive behavior based on the data it receives. Service provider device 110 may contain one or more electronic devices operating in a cloud environment, as described in FIG. 1 and FIG. 2. Additionally, the portions of serviced provider device 110 operating the aggressor monitoring program 112, is associated with the first user. Service provider device 110 may include internal and external hardware components, as depicted and described in further detail below with reference to FIG. 5.

Historical data database 114 represents a collection of information detailing historical interactions between multiple sets of mobile devices, such as first user electronic device 130, second user electronic device 140 and third party electronic device 150. Such details may include whether the interactions were defined as an aggressive act, proximity between the devices during each interaction, audio information, visual information, physiological information, or any other relevant information that may be obtained from first user electronic device 130, second user electronic device 140 and third party electronic device 150.

Aggressor monitoring program 112 represents a program that receives information from remote detection program 132, remote detection program 142 and remote detection program 152, and makes a determination of whether a user of a mobile device, such as the user of first user electronic device 130 (hereinafter referred to as "the first user"), is encountering a person determined to be aggressive. In the example embodiment, aggressor monitoring program 112 automatically, and silently, determines whether an interaction is aggressive so as to not alert a potential aggressor. In addition, in the example embodiment, once the program has been installed or receives a command to commence operation, aggressor monitoring program 112 may determine whether an interaction is aggressive without input, either active or passive, from the first user. Such monitoring of an aggressive act may be continuous, and independent of a direct request, from the first user in order to detect aggressive acts in all situations. The aggressor monitoring program 112 may additionally alert individuals or government agencies to intervene in the aggressive act. Further, aggressor monitoring program 112 may direct remote detection program 132, remote detection program 142 and remote detection program 152 to record, store and/or transmit data pertaining to the aggressive act, which may aid in finding or prosecuting an aggressor. Aggressor monitoring program 112 may create models, based on the data contained in historical data 114 that aid in the determination of the aggressive act. While the aggressor monitoring program 112 is illustrated as being located on service provider device 110, aggressor monitoring program 112 may additionally be located, in whole or in part, on first user electronic device 130. Aggressor monitoring program 112 is described in more detail below, with reference to FIGS. 4*a* and 4*b*.

Referring to step S210, the aggressor monitoring program 112 receives information from remote detection program 132 located on first user electronic device 130, and possibly remoted detection program 142 located on second user electronic device 140. The aggressor monitoring program 112 may receive audio, visual, location, physiological or any other relevant information from first user electronic device 130. In embodiments where second user electronic device 140 has been detected, the aggressor monitoring program 112 may receive audio, visual, location, physiological or any other relevant information from second user electronic device 140. The amount of information received during step S210 may be increased or decreased based on feedback from step S222. In an embodiment, GPS location information may be routinely received by the aggressor monitoring program 112 from first user electronic device 130 and second user electronic device 140 for continuous monitoring for aggressive acts.

Referring to step S220, the aggressor monitoring program 112 determines a first user is undergoing an aggressive act based on the information obtained in step S210. An aggressive act may be harassment or a physical attack from an aggressor, such as the user of second user electronic device (hereinafter referred to as "the second user") towards a user of a mobile device, such as the first user. In the example embodiment, the aggressor monitoring program 112 determines the aggressive act based on input received by remote detection program 132 and/or remote detection program 142 during step S210. As explained in further detail below, the aggressor monitoring program 112 may compare the received information from step S210 to behavior models or specific criterion obtained from historical data database 114, or inputs reflecting relationships between the first user and second user, located in historical data database 114, to determine the likelihood that an aggressive action is occurring. In each instance, the aggressor monitoring program 112 may make the determination without any input (or lack of input) from the first user as the aggressive act is occurring. The aggressor monitoring program 112 may determine that there is an aggressive act occurring if the likelihood that the aggressive action is occurring is above a threshold value. For example, the aggressor monitoring program 112 may make a determination that there is a medium likelihood that the first user is undergoing an aggressive act, and in instances where the threshold value medium and below, the aggressor monitoring program 112 would make a determination that an aggressive act is occurring. The threshold value may be value that minimizes the amount of false positive determinations, while still accounting for all of the aggressive acts that may occur.

In an example embodiment, the aggressor monitoring program 112 may determine if a first user is undergoing an aggressive act based on a deviation from expected behavior of the first user. In such an embodiment, a first user's expected behavior may be determined by creating a model of a first user's travel patterns using walking speed and direction time of day gathered from first user electronic device 130. The model may then make a prediction of the expected path and speed of travel the first user would typically take when going to an expected destination. In cases where there is no user information or insufficient user information regarding the expected destination, aggressor monitoring program 112 may utilize map software and determine an expected duration time for the trip. In some instances, the expected destination may be based on calendar entries from the first user's phone (e.g. dentist appointment) or based on historical trends (e.g. at 7 P.M. the first user goes home) which may be collected by utilizing a GPS module on the first user electronic device 130. The aggressor monitoring program 112 may then make a determination that an aggressive act is occurring based on the first user drastically deviating from an expected course. For example, if the expected path of a first user at 7 pm is a walk through a park that progresses along paved walkways, then aggressor monitoring program 112 may typically receive information detailing the first user walking at a leisurely pace. Therefore, if at 7 pm, aggressor monitoring program 112 receives information detailing that the first user has started running off of the path, through the woods, and over a creek, the aggressor monitoring program 112 could determine that an aggressive act is occurring. In other embodiments, aggressor monitoring program 112 may additionally make use of physiological data (e.g. heartrate) to determine stress and activity levels of the first user, which may further aid prediction of the occurrence of an aggressive act. In this embodiment, aggressor monitoring program 112 may utilize a heartrate monitor present on the first user electronic device 130.

In another embodiment, aggressor monitoring program 112 may use information available to it from remote detection program 142 to further determine whether an aggressive act is occurring. For example, aggressor monitoring program 112 may receive information from remote detection program 132 and remote detection program 142 indicating that the user of second user device 140 (i.e., the second user) is following the first user for several blocks, prior to the first user deviating from their predicted course, which may predict an aggressive act. This may be accomplished by aggressor monitoring program 112 monitoring first user electronic device 130 and second user device 140, and utilizing GPS module present on each device to determine the location of each device. Additionally, aggressor monitoring program 112 may receive information, such as GPS location information, indicating the second user (and/or additional users) is blocking the path of, or surrounding, the user of first user device 130. In further embodiments, program may use publicly available information (e.g. arrest records) in order to determine the likelihood that a user of a device (such as second user device 140) is an aggressor.

In additional embodiments, previous interactions between the first user and the second user may be taken into account. For example, the aggressor monitoring program 112 may receive information entered by the first user, or pulled from public records, of previous aggressive acts, or threats of aggressive acts, by the second user towards the first user (e.g. restraining order, previous complaints). In another example, if aggressor monitoring program 112 determines that the second user has made threats or has written derogatory remarks on the social media site of the first user, aggressor monitoring program 112 may indicates that the second user is an aggressor with respect to the first user. In such instances, the aggressor monitoring program 112 may determine an aggressive act is occurring based on the proximity of the second user to the first user. In one embodiment, proximity may be determined by using location data (e.g. GPS) of the first user and the second user. In another embodiment, proximity may be determined by remote detection program 132 detecting a signature of second user electronic device 140, either by a signal initiated by remote detection program 142 or using characteristics inherent to second user electronic device 140 (e.g. simcard data). Such detection may be through peer-to-peer connection techniques such as Bluetooth or Wi-Fi signals.

If the aggressor monitoring program 112 determines an aggressive act is occurring, step S220 proceeds to step S234. If the aggressor monitoring program 112 does not determine there is an aggressive act, step S220 proceeds to step S234.

Referring to step S222, the aggressor monitoring program 112 adjusts the amount of information received by the aggressor monitoring program 112. The aggressor monitoring program 112 may determine that more or less information is necessary based on the determined likelihood that the aggressive action is occurring, as determined in step S220. If the likelihood that the aggressive action is occurring is extremely low (e.g. highly unlikely), the aggressor monitoring program 112 may determine that less input is necessary to make an accurate determination. Thus, the aggressor monitoring program 112 may send a signal to disable features, or additional devices, that were collecting information using remote detection program 132 on first user electronic device 130, remote detection program 142 on second user electronic device 140, and remote detection program 152 on third party device 150.

If the aggressor monitoring program 112 requires additional information to make an accurate determination of whether an aggressive act is occurring, the aggressor monitoring program 112 may utilize additional features in order to gather further information. In an embodiment, the aggressor monitoring program 112 may utilize additional features of the first user electronic device 130 and/or the second user electronic device 140, such as camera, microphone, etc.

Referring to step S234, following detection of an aggressive act towards the first user, the aggressor monitoring program 112 may utilize features on the first user electronic device 130, and record data from such features. The features may provide audio, visual, location, or any other applicable data concerning the aggressive act. The first user data may be stored on first user electronic device 130, or transmitted to service provider device 110.

Referring to step S236, aggressor monitoring program 112 determines if the second user electronic device 140 is detected. In one embodiment, the aggressor monitoring program 112 may determine the presence of the second user electronic device 140 by finding mobile devices in close proximity (e.g. within 5 feet) of the first user electronic device 130. In another embodiment, the aggressor monitoring program 112 may receive information detailing unique signatures of mobile devices detected by, and in close proximity to, the first user electronic device 130. In another embodiment, the aggressor monitoring program 112 may retrieve identifying information from the second user electronic device 140, and cross reference the identifying information with a database to identify the owner of the second mobile device. If the aggressor monitoring program 112 detects the second user electronic device 140, aggressor monitoring program 112 proceeds to step S246. If the aggressor monitoring program 112 does not detect the second user electronic device 140, aggressor monitoring program 112 proceeds to step S238.

Referring to step S246, following detection of an aggressive act towards the first user and detecting second user electronic device 140, the aggressor monitoring program 112 may utilize features on the second user electronic device 140, and obtain data from such features. The features may provide audio, visual, location, or any other applicable data concerning the aggressive act. Additionally, the aggressor monitoring program 112 may obtain identifying information from the second user electronic device 140 in order to later identify the aggressor. Such identifying information may be, for example, contact list, calendar, phone calls, text messages, phone number. The second user data may be temporarily stored on second user electronic device 140, or transmitted to service provider device 110.

Referring to step S238, aggressor monitoring program 112 determines if a third party device 150 is detected. In one embodiment, the aggressor monitoring program 112 may determine a third party electronic device 150 by finding mobile devices in close proximity (e.g. within 50 feet) of the first user's mobile device 130. In another embodiment, the aggressor monitoring program 112 may receive information detailing unique signatures of mobile devices detected by, and in close proximity to, the first user electronic device 130. If the aggressor monitoring program 112 detects the third party device 150, aggressor monitoring program 112 proceeds to step S246. If the aggressor monitoring program 112 does not detect the third party device 150, aggressor monitoring program 112 proceeds to step S232.

Referring to step S246, following detection of an aggressive act towards the first user, the aggressor monitoring program 112 may utilize features on the third party electronic device 150, and obtain third party data from such features. The features may provide audio, visual, location, or any other applicable data concerning the aggressive act. The third party data may be temporarily stored on third party electronic device 150, or transmitted to service provider device 110.

Referring to step S232, aggressor monitoring program 112 alerts appropriate parties that an aggressive act is occurring via network 120. Appropriate parties may include law enforcement, emergency medical services or other public entities that would be responsible for responding to an aggressive act. In additional embodiments, appropriate parties may be people in close proximity to the location of the aggressive act, as determined by step S238. In some embodiments, an alert may be transmitted to the second user, as determined in step S236, to dissuade them from carrying out, or furthering, an aggressive act. The alerts may be any type of signal capable of conveying the location, and the need for help, to the third party such as, for example, automated phone call, text, emergency message.

Referring to step S250, aggressor monitoring program 112 receives any recorded data from first user electronic device 130, second user electronic device 140 and third party electronic device 150. In an embodiment, aggressor monitoring program 112 receives the data from each device via network 120. In another embodiment, if there is a momentary lapse in direct access from first user electronic device 130, second user electronic device 140 or third party electronic device 150 to service provider device 110, first user electronic device 130 may act as an intermediary and receive the recorded data via peer-to-peer transmission via 120. Once first user electronic device 130 has access to service provider device 110 via 120, the data may be transmitted to service provider device 110. The data may then be sent to public agencies in order to aid in capture and prosecution of the second user for the aggressive act.

FIG. 5 depicts a block diagram of components of service provider device 110, first user electronic device 130, second user electronic device 140 and third party electronic device 150, in accordance with an illustrative embodiment of the present invention. It should be appreciated that FIG. 5 provides only an illustration of one implementation and does not imply any limitations with regard to the environments in which different embodiments may be implemented. Many modifications to the depicted environment may be made.

Service provider device 110, first user electronic device 130, second user electronic device 140 and third party electronic device 150 include communications fabric 302, which provides communications between computer processor(s) 304, memory 306, persistent storage 308, communications unit 312, and input/output (I/O) interface(s) 314. Communications fabric 302 can be implemented with any architecture designed for passing data and/or control information between processors (such as microprocessors, communications and network processors, etc.), system memory, peripheral devices, and any other hardware components within a system. For example, communications fabric 302 can be implemented with one or more buses.

Memory 306 and persistent storage 308 are computer-readable storage media. In this embodiment, memory 306 includes random access memory (RAM) 316 and cache memory 318. In general, memory 306 can include any suitable volatile or non-volatile computer-readable storage media.

The programs aggressor monitoring program 112 in service provider device 110; remote detection program 132 in first user electronic device 130; remote detection program 142 in second user electronic device 140; and remote detection program 152 in third party electronic device 150 are stored in persistent storage 308 for execution by one or more of the respective computer processors 304 via one or more memories of memory 306. In this embodiment, persistent storage 308 includes a magnetic hard disk drive. Alternatively, or in addition to a magnetic hard disk drive, persistent storage 308 can include a solid state hard drive, a semiconductor storage device, read-only memory (ROM), erasable programmable read-only memory (EPROM), flash memory, or any other computer-readable storage media that is capable of storing program instructions or digital information.

The media used by persistent storage 308 may also be removable. For example, a removable hard drive may be used for persistent storage 308. Other examples include optical and magnetic disks, thumb drives, and smart cards that are inserted into a drive for transfer onto another computer-readable storage medium that is also part of persistent storage 308.

Communications unit 312, in these examples, provides for communications with other data processing systems or devices. In these examples, communications unit 312 includes one or more network interface cards. Communications unit 312 may provide communications through the use of either or both physical and wireless communications links. The aggressor monitoring program 112 in service provider device 110; remote detection program 132 in first user electronic device 130; remote detection program 142 in second user electronic device 140; and remote detection program 152 in third party electronic device 150 may be downloaded to persistent storage 308 through communications unit 312.

I/O interface(s) 314 allows for input and output of data with other devices that may be connected to service provider device 110, first user electronic device 130, second user electronic device 140, and third party electronic device 150. For example, I/O interface 314 may provide a connection to external devices 320 such as a keyboard, keypad, a touch screen, and/or some other suitable input device. External devices 320 can also include portable computer-readable storage media such as, for example, thumb drives, portable optical or magnetic disks, and memory cards. Software and data used to practice embodiments of the present invention, e.g., The aggressor monitoring program 112 in service provider device 110; remote detection program 132 in first user electronic device 130; remote detection program 142 in second user electronic device 140; and remote detection program 152 in third party electronic device 150, can be stored on such portable computer-readable storage media and can be loaded onto persistent storage 308 via I/O interface(s) 314. I/O interface(s) 314 can also connect to a display 322.

Display 322 provides a mechanism to display data to a user and may be, for example, a computer monitor.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While steps of the disclosed method and components of the disclosed systems and environments have been sequentially or serially identified using numbers and letters, such numbering or lettering is not an indication that such steps must be performed in the order recited, and is merely provided to facilitate clear referencing of the method's steps.

Furthermore, steps of the method may be performed in parallel to perform their described functionality.

What is claimed is:

1. A method for assessing interactions towards an electronic device, comprising:

monitoring a pattern of actions of a first user, wherein the first user is associated with a first electronic device;

determining, via the first electronic device, that at least one action from the first user indicates an aggressive act is being perpetrated on the first user, wherein determining the aggressive act is being perpetrated on the first user comprises:

determining a predicted travel path of the first electronic device, wherein the predicted travel path comprises a predicted user location and a predicted user speed;

monitoring a location and a movement speed of the first electronic device; and determining the aggressive act is being perpetrated on the first user based on a deviation of the first user from the predicted travel path, wherein the deviation is selected from the group consisting of: a difference between the location of the first electronic device and the predicted user location, and a difference between the movement speed of the first electronic device and the predicted user speed;

based on determining that the aggressive act is being perpetrated on the first user, and based on detecting a second electronic device is within a threshold distance to the first electronic device, activating a device component of the second electronic device, wherein the device component comprises at least one component selected from the group consisting of: an audio recording component and a visual recording component.

2. The method of claim 1, further comprising receiving information from the activated device component of the second electronic device by the first electronic device.

3. The method of claim 1, further comprising receiving data obtained by the second electronic device, wherein the data obtained by the second electronic device comprises data identifying a second user of the second electronic device; and wherein determining, via the first electronic device, that at least one action from the first user indicates the first user is undergoing an aggressive act comprises:

searching one or more databases for information associated with the first user and the second user, and determining that a proximity between the first electronic device and the second electronic device is below a threshold value.

4. The method of claim 3, wherein the information associated with the first user and the second user comprises one or more of: previous legal actions between the first user and the second user, previous social media communications between the first user and the second user, and previous aggressive acts by the second user against the first user.

5. The method of claim 1, wherein determining, via the first electronic device, that at least one action from the first user indicates the first user is undergoing an aggressive act further comprises receiving physiological data about the first user from the first electronic device, and determining the received physiological data matches a physiological data pattern indicative of a victim of an aggressive act.

6. A computer program product for assessing interactions towards an electronic device:

one or more computer-readable storage devices and program instructions stored on at least one of the one or more tangible storage devices, the program instructions comprising:

program instructions to monitor a pattern of actions of a first user, wherein the first user is associated with a first electronic device; program instructions to determine, via the first electronic device, that at least one action from the first user indicates an aggressive act is being perpetrated on the first user, wherein program instructions to determine the aggressive act is being perpetrated on the first user comprises:

program instructions to determine a predicted travel path of the first electronic device, wherein the predicted travel path comprises a predicted user location and a predicted user speed;

program instructions to monitor a location and a movement speed of the first electronic device;

and program instructions to determine the aggressive act is being perpetrated on the first user based on a deviation of the first user from the predicted travel path, wherein the deviation is selected from the group consisting of: a difference between the location of the first electronic device and the predicted user location, and a difference between the movement speed of the first electronic device and the predicted user speed;

based on determining that the aggressive act is being perpetrated on the first user, and based on detecting a second electronic device is within a threshold distance to the first electronic device, program instructions to activate a device component on the second electronic device, wherein the device component comprises at least one component selected from the group consisting of: an audio recording component and a visual recording component.

7. The computer program product of claim 6, further comprising program instructions to receive information from the activated device component of the second electronic device by the first electronic device.

8. The computer program product of claim 6, further comprising program instructions to receive data obtained by the second electronic device, wherein the data obtained by the second electronic device comprises data identifying a second user of the second electronic device; and wherein the program instructions to determine, via the first electronic device, that at least one action from the first user indicates the first user is undergoing an aggressive act:

program instructions to search one or more databases for information associated with the first user and the second user, and program instructions to determine that a proximity between the first electronic device and the second electronic device is below a threshold value.

9. The computer program product of claim 8, wherein the information associated with the first user and the second user comprises one or more of: previous legal actions between the first user and the second user, previous social media communications between the first user and the second user, and previous aggressive acts by the second user against the first user.

10. The computer program product of claim 6, wherein the program instructions to determine, via the first electronic device, that at least one action from the first user indicates the first user is undergoing an aggressive act comprises receiving physiological data about the first user from the first electronic device, and program instructions to determine the received physiological data matches a physiological data pattern indicative of a victim of an aggressive act.

11. A computer system for assessing interactions towards an electronic device, the computer system comprising:

one or more processors, one or more computer-readable memories, one or more computer-readable tangible storage devices, and program instructions stored on at least one of the one or more storage devices for execution by at least one of the one or more processors via at least one of the one or more memories, the program instructions comprising:

program instructions to monitor a pattern of actions of a first user, wherein the first user is associated with a first electronic device;

program instructions to determine, via the first electronic device, that at least one action from the first user indicates an aggressive act is being perpetrated on the first user is undergoing an aggressive act, wherein program instructions to determine the aggressive act is being perpetrated on the first user comprises:

program instructions to determine a predicted travel path of the first electronic device, wherein the predicted travel path comprises a predicted user location and a predicted user speed;

program instructions to monitor a location and a movement speed of the first electronic device;

and program instructions to determine the aggressive act is being perpetrated on the first user based on a deviation of the first user from the predicted travel path, wherein the deviation is selected from the group consisting of:

a difference between the location of the first electronic device and the predicted user location, and a difference between the movement speed of the first user and the predicted user speed;

based on determining that the aggressive act is being perpetrated on the first user, and based on detecting a second electronic device is within a threshold distance to the first electronic device, program instructions to activate a device component on the second electronic device, wherein the device component comprises at least one component selected from the group consisting of: an audio recording component and a visual recording component.

12. The computer system of claim 11, further comprising program instructions to receive data obtained by the second electronic device, wherein the data obtained by the second electronic device comprises data identifying a second user of the second electronic device; and wherein the program instructions to determine, via the first electronic device, that at least one action from the first user indicates the first user is undergoing an aggressive act:

program instructions to search one or more databases for information associated with the first user and the second user, and program instructions to determine that a proximity between the first electronic device and the second electronic device is below a threshold value.

13. The computer system of claim 12, wherein the information associated with the first user and the second user comprises one or more of: previous legal actions between the first user and the second user, previous social media communications between the first user and the second user, and previous aggressive acts by the second user against the first user.

14. The computer system of claim 11, wherein the program instructions to determine, via the first electronic device, that at least one action from the first user indicates the first user is undergoing an aggressive act comprises receiving physiological data about the first user from the first electronic device, and program instructions to determine the received physiological data matches a physiological data pattern indicative of a victim of an aggressive act.

* * * * *